United States Patent [19]

Rulseh

[11] 3,963,182

[45] June 15, 1976

[54] BURNER

[75] Inventor: Roy M. Rulseh, Milwaukee, Wis.

[73] Assignee: Aqua-Chem, Inc., Milwaukee, Wis.

[22] Filed: June 24, 1974

[21] Appl. No.: 481,999

Related U.S. Application Data

[63] Continuation of Ser. No. 317,211, Dec. 21, 1972, abandoned.

[52] U.S. Cl. ..... 239/404; 239/406; 239/416.5; 239/425

[51] Int. Cl.[2] ..... B05B 7/10

[58] Field of Search ..... 431/182, 183, 185, 187, 431/188, 351, 353; 239/400, 403, 416.4, 416.5, 417.3, 424, 425, 404–406

[56] References Cited

UNITED STATES PATENTS

| | | | |
|---|---|---|---|
| 1,451,063 | 4/1923 | Anthony | 239/404 |
| 1,841,698 | 1/1932 | Barber | 431/185 |
| 1,934,837 | 11/1933 | Zulver | 239/404 |
| 2,815,069 | 12/1957 | Garraway | 431/185 |
| 2,873,099 | 2/1959 | Wittke | 239/404 |
| 2,989,119 | 6/1961 | Burt | 431/183 |
| 3,254,846 | 6/1966 | Schreter et al. | 239/400 |
| 3,790,086 | 2/1974 | Masai | 239/406 |

FOREIGN PATENTS OR APPLICATIONS

| | | | |
|---|---|---|---|
| 6,160 | 2/1927 | Australia | 239/405 |

*Primary Examiner*—Carroll B. Dority, Jr.
*Attorney, Agent, or Firm*—Fred Wiviott

[57] ABSTRACT

A burner operative to inject fuel and a portion of the amount of air required for stoichiometric combustion as a core into a combustion zone and the balance of the air required for substantially stoichiometric combustion is introduced coaxially around the core to form an air jacket. The burner includes a central fuel delivery pipe, a first coaxial atomizing air delivery pipe and a second coaxially surrounding air delivery pipe. The central fuel delivery pipe terminates in an outer conical surface and the first coaxial air delivery pipe terminates in a spaced coaxial inner surface and a shaped transverse outer surface for shaping the central fuel-rich flame core. The second coaxial air delivery pipe delivers an air jacket to form the fuel core and additional air is delivered coaxially around a baffle assembly and in a direction generally parallel to the core for additional flame shaping.

29 Claims, 5 Drawing Figures

BURNER

BACKGROUND OF THE INVENTION

This is a continuation of application Ser. No. 317,211 filed Dec. 21, 1972 and now abandoned.

This invention relates to a fuel burning method and apparatus which reduces the level of nitrogen oxides, carbon monoxide, carbonaceous particulates and unburned hydrocarbons in the exhaust gases.

The conventional method of burning gaseous, liquid, and finely divided solid fuels is to inject the fuel along with air in excess of the stoichiometric amount for combustion into a combustion chamber under conditions which promote intimate mixing of the air and fuel for the purpose of more complete combustion of the fuel. Generally, the combustion air is turbulently injected at the fuel injection point to promote immediate mixing. The turbulence encountered in these vessels tended to increase the power required for air delivery and to yield exhaust gases which were high in carbon monoxide, particulate matter, unburned hydrocarbons and nitrogen oxides.

The turbulent air injection was conventionally achieved by spinning the combustion air prior to injection at the burner. While this technique resulted in turbulent mixing action at the burner, it was self-defeating in two respects. First, turbulent injection of the air increases the pressure drop through the furnace and places a higher demand on the air delivery blower used to pump air into the combustion zone than would be required if the air were pumped substantially linearly into the combustion zone. Second, although mixing of the air and fuel at the burner is accomplished by the turbulent air injection, such mixing is not fully effective because the spinning air mass tends to move away from the fuel due to centrifugal force.

SUMMARY OF THE INVENTION

In accordance with the invention, the fuel mixture is injected from a burner nozzle with a spinning motion along with a thin coaxial outer stream of air to form a fuel-rich flame core in the combustion zone. The balance of air required to complete stoichiometric combustion is injected coaxially around the core from the injection end of the combustion zone to form a parallel sheath of air flowing surrounding the core. The sheath air and flame core remains substantially separate at points axially close to the fuel injection point with substantial mixing of the core and sheath air being delayed until they pass axially along the combustion chamber wherein progressive mixing occurs. It is believed that this delayed mixing action permits some heat radiation from the flame before complete combustion occurs so that the flame temperature is below about 2500° F so that substantial amounts of nitrogen oxides are not formed. Further, because the burner configuration permits air fuel mixing with a minimum of turbulence, less power is required to drive the air delivery blower.

It is a primary object of this invention to provide a combustion method and apparatus wherein nitrogen oxides, carbon monoxide, gaseous and particulate hydrocarbons and carbonaceous particulates in the exhaust gases are substantially minimized.

Another object of this invention is to provide a combustion method and apparatus for minimizing the aforementioned atmospheric pollutants which is also more efficient than conventional combustion methods.

How the aforementioned and other more specific objects of the invention are achieved will appear in the more detailed description of an illustrative embodiment of the invention which follows.

DESCRIPTION OF A PREFERRED EMBODIMENT

Figure 1:
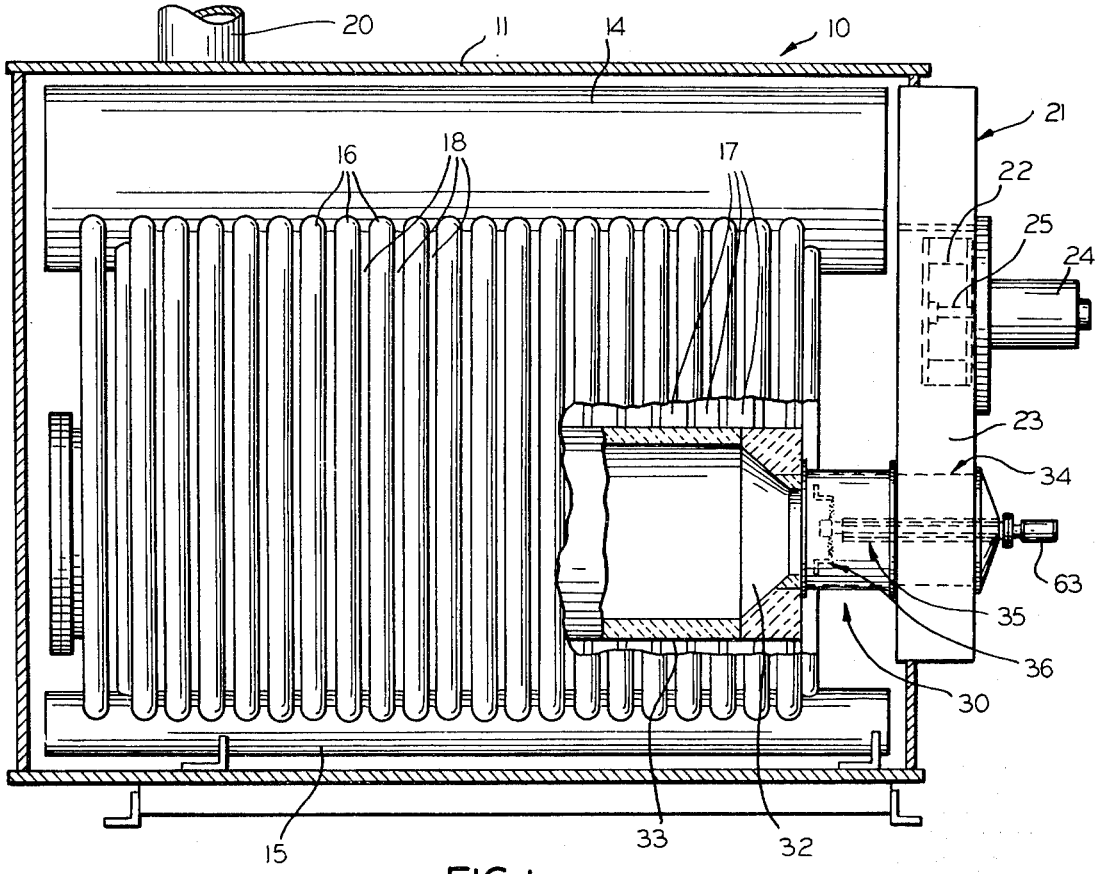
FIG. 1 is a longitudinal sectional view of a boiler incorporating the burner according to the invention.

Although the principles of the new combustion method and apparatus are applicable to various combustion devices, the invention will be described for convenience in connection with a water tube boiler such as illustrated in FIG. 1. The boiler 10 is a conventional construction comprising an outer metallic shell 11 for enclosing an upper drum 14 and a lower drum 15 which are connected together by means of a plurality of water filled tubes 16 on the foreground side and a plurality of tubes 17 on the background side as viewed in FIG. 1. The tubes on each side of the boiler may be interconnected by metal webs 18 welded between them and the combination of the tubes and webs on each side of the boiler interior define a cavity in which heat is exchanged between hot combustion gases and water or steam within the tubes. An exhaust stack 20 is provided near the rear end of the boiler for discharging the exhaust gases after the same have passed in a heat exchange relationship with the tubes 16 and 17.

A housing 21 may be affixed to the front of boiler 10 for enclosing a fan 22 at its upper end and a plenum chamber 23 at its lower end. A fan drive motor 24 may be suitably mounted on housing 21 and is coupled to fan 22 by a shaft 25. When driven by motor 24, the fan draws air through an intake, not shown, for compression and delivery to the plenum chamber 23.

A burner assembly 30 according to the preferred embodiment of the invention extends through the plenum chamber 23 in housing 21 and has its inner end in registry with the inlet orifice refractory 32 of the furnace 33. The burner assembly 30 generally includes a damper assembly 34 for delivering any suitable fuel, such as oil to the combustion chamber and an air delivery system 36 for controlling the distribution of combustion air in relation to the nozzle assembly 35.

Figure 2:
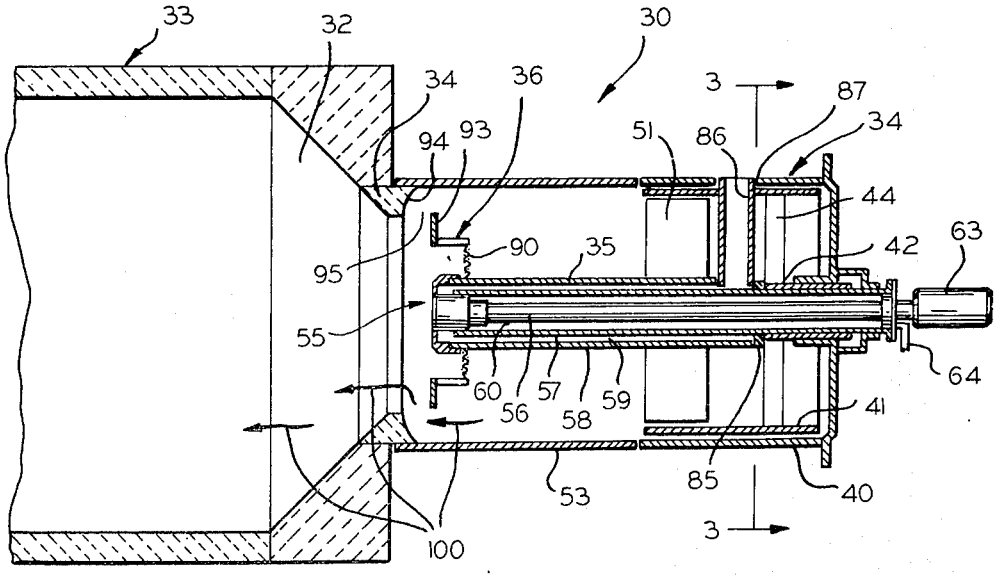
FIG. 2 is an enlarged elevational view partly in section, of the burner assembly illustrated in FIG. 1.
Figure 3:
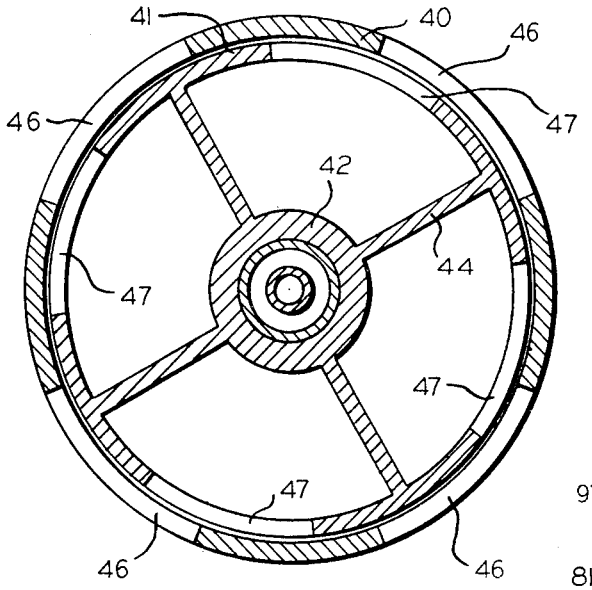
FIG. 3 is a transverse sectional view of the damper assembly taken along line 3—3 of FIG. 2.

Referring now to FIGS. 2 and 3, the damper assembly 34 is shown to consist of an outer cylindrical housing 40 which is fixedly mounted in the plenum chamber 23 of housing 21 and an inner concentric damper member 41 which is rotatably mounted on the cylindrical nozzle assembly 35 by means of a central hub 42 and a plurality of radial struts 44 extending between hub 42 and the inner member 41. Housing 40 and damper member 41 each have a plurality of spaced apart apertures 46 and 47, respectively, which occupy slightly less than one half of their surfaces. The apertures 47 are movable into and out of registry with apertures 46 as the damper member 41 is rotated. It will be appreciated that the angular position of the damper member 41 relative to the housing 40 will determine the quantity of combustion air provided to the burner 10 from the plenum chamber 23. This angular relationship may be regulated in any manner well known in the art, such as by a servo motor (not shown) which positions the damper member 41 angularly in response to a heat demand signal from a control furnace. A plurality of radially extending fixed platelike vanes 51 extend between the interior of damper member 41 and nozzle assembly 35. The vanes 51 act to reduce spinning motion of the air flow through damper assembly 34 and direct the air flow from the damper assembly into a generally straight axial flow to the air delivery system 38 through a cylindrical burner housing 53 extending between the damper assembly 34 and the orifice refractory 32 concentrically surrounding the burner assembly 35.

Figure 4:
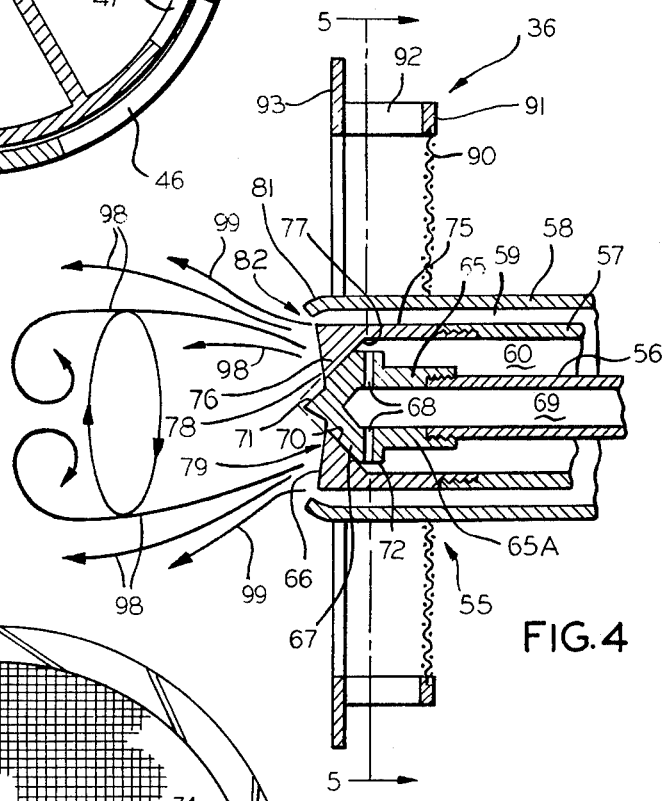
FIG. 4 is an enlarged vertical sectional view of the burner nozzle.

The nozzle assembly 35 is shown in FIGS. 2 and 4 generally to include a nozzle 55 disposed adjacent the furnace inlet 32 and concentrically arranged and spaced apart hollow pipes 56, 57 and 58 for respectively delivering fuel, atomizing air and tertiary air. The gap 59 between pipes 57 and 58 defines an annular tertiary air flow passage and a gap 60 between pipes 56 and 57 defines an annular atomizing air passage. The pipes 56 and 57 extend through the damper assembly 34 where the pipe 56 is connected at its outer end to a suitable burner gun assembly 63 adapted to supply fuel under pressure from a source (not shown).

Figure 5:
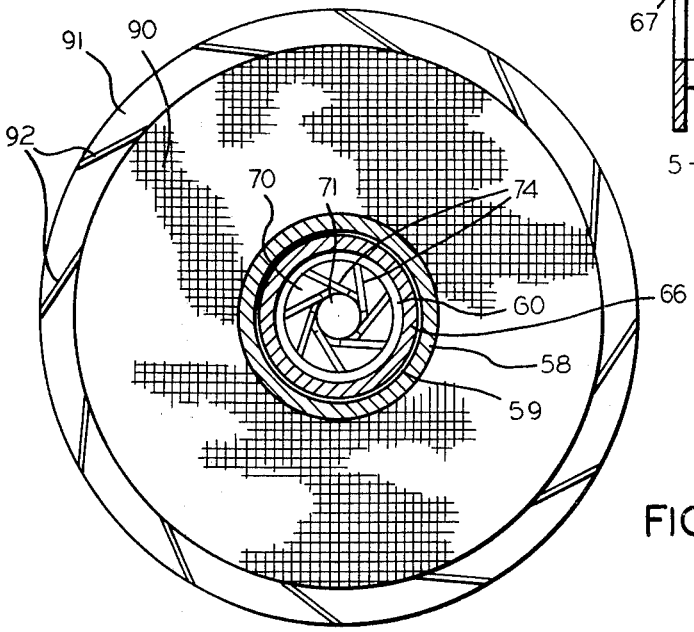
FIG. 5 is a transverse view of the burner nozzle taken along line 5—5 of FIG. 4.

A fitting 64 is also provided for supplying pressurized atomizing air from a source (not shown) to the gap 60 between pipes 56 and 57. As seen particularly in FIGS. 4 and 5, the nozzle 55 includes first and second nozzle members 65 and 66 which may be threadably received on the ends of the fuel delivery pipe 56 and the atomizing air delivery pipe 57 respectively. The first member 65 has a hollow base portion 65A which engages pipe 56, and has a larger diameter head portion 67. A plurality of passages 68 extend radially through head portion 67 to connect the interior 69 of pipe 56 with the annular atomizing air passage 60 between tubes 56 and 57. As best seen in the sectional view FIG. 4, the frontal exterior surface of the head portion 67 consists of a stepped cone having an elevated frusto-conical surface portion 70 which steps down to form a conical tip portion 71 having its apex extending toward the interior of the furnace. The base of the stepped frusto-conical portion 70 terminates in a cylindrical surface 72 spaced from the interior of the second nozzle member 66 to form the gap 60. As is seen in FIG. 5, a plurality of grooves 74 are formed in the elevated frusto-conical portion 70 of the head 67 between the cylindrical base portion 72 and the conical tip portion 71, the grooves 74 being oriented generally tangentially relative to the base of the tip portion 71. The grooves 74 thus form communicating passageways between the gap 60 and the tip 71 of the head portion 67.

The second nozzle member 66 has a generally cylindrical body portion 75 which forms an extension of the pipe 57 and an inwardly extending terminal end 76 having an inner conical surface 77 which engages the elevated frusto-conical surface 70 of head portion 67. Member 66 also includes an outer, generally frusto-conical surface 78 which intersects the inner surface 77 at a point adjacent the stepped portion of head 67 to define a circular aperture 79. The grooves 74 place the gap 60 in communication with the aperture 79.

The tertiary air delivery pipe 58 terminates in an annular inwardly bent tip portion 81 extending slightly past and spaced from the end of the nozzle member 60.

The tertiary air passage 59 thus terminates in a coaxial annular passage 82 around a periphery of nozzle 55. As seen in FIG. 2, the tertiary air delivery pipe 58 extends back to a terminal point within the damper assembly 34 where it is sealed and supported by an annular member 85 which holds it in a spaced coaxial relationship relative to the atomizing air pipe 57. A radially extending duct 86 extends through the damper assembly 34 from a point adjacent the seal member 85 at the end of the tertiary air duct 58. The duct 86 forms a connecting passageway between the plenum chamber and the tertiary air interior of the pipe 58. A segmental opening 87 is formed in the periphery of the rotatable damper member 41 to permit rotation of member 41 relative to the duct 86.

With reference to FIGS. 2, 4 and 5, the air delivery system 36 is seen to include a radially extending porous mesh disc 90 which is axially spaced from the end of nozzle 55 and is affixed to the outer periphery of the tertiary air delivery pipe 58. An annular rim 91 is affixed to the outer perimeter of the porous disc 90 and has a plurality of axially extending spaced vanes 92 extending from the face of the rim 91 toward the furnace opening 32. The spaced vanes 92 are generally tangentially oriented relative to the periphery of rim 90. A second annular disc 93 is affixed to the opposite ends of vanes 92 and lies in a plane generally perpendicular to the axis of the nozzle assembly 35. The inner diameter of the disc 93 is substantially the same as the outer diameter of mesh disc 90. As seen in FIG. 2 the furnace inlet refractory 34 has a reverse surface 94 which is arcuate in vertical section facing disc 93. The disc 93 and surface 94 form an annular flow space 95 between housing 53 and the furnace 33. Parallel flow paths are formed through the spaced vanes 92 and the porous disc 90.

In operation of the burner apparatus, fuel is supplied by the burner gun assembly 63 to the interior 69 of the fuel delivery pipe 56, while at the same time atomizing air under pressure is supplied to the annular atomizing air flow gap 60 between delivery pipe 57 and the fuel delivery pipe 56. The atomizing air flows through the gap 60 between the first nozzle member 65 and the atomizing air delivery pipe 57 and then passes through the grooves 74 formed in the head portion 67 on out through the aperture 79 in the outer nozzle member 66. As the atomizing air flows across the passages 68 fuel is drawn into the atomizing air flow and atomized thereby flowing in admixture with the atomizing air through the grooves 74 to the aperture 79. The conical shape of the head member 67 combined with the tangential orientation of the grooves 74 imparts a spiral flow to the atomized fuel mixture as it exits the aperture 79 and moves along surface 78 of member 66 closely following its surface according to the commonly known Coanda effect. The action of the spirally moving atomized fuel as it passes over the conical surface 78 tends to form a fuel-rich core 98 of atomized fuel which is generally hyperbolically shaped in the area of the nozzle and which progresses into the furnace interior through the opening 32. Conventional ignition means may be provided for initiating combustion of the fuel-rich core stream. At the same time that the atomized fuel mixture is being ejected from the nozzle 55, tertiary air is supplied to the outer tertiary air delivery pipe 58 as the result of air within the plenum chamber flowing down duct 86 into the annular tertiary air flow space 59 between the tertiary air delivery pipe 58 and the atomizing air pipe 57. This pressurized tertiary air is injected coaxially around the spinning fuel-rich core through the annular exit passage 82 and tends to follow the hyperbolically shaped atomized fuel core and to maintain a jacket of air along the surface of the core as indicated by the arrows 99 in FIG. 4. This tends to delay mixing of the atomized fuel and surrounding air.

In accordance with the invention, the tertiary air comprises only a minor portion of the amount of air necessary to support stoichiometric combustion of the fuel mixture ejected from the nozzle 55. Accordingly, the major amount of combustion air flows through the damper assembly 34 in quantities dependent upon the angular position of the rotating damper 41 relative to the outer cylindrical shell 40, which angular position varies the alignment of the apertures 46 and 47. This air flow proceeds through the straightener vanes 51 and flows generally axially along the burner assembly toward the air delivery apparatus 36. Most of this additional combustion air flows around the plate 93 and through the annular flow space 95.

With reference to FIG. 2, the air flowing around plate 93, as symbolized by arrows 100 initially passes inwardly toward the fuel-rich core and in a direction generally parallel to arcuate surface 94 on the inlet refractory 34. In the vicinity of the furnace inlet 32, the air 100 changes direction and proceeds longitudinally down the furnace 33 and in a direction generally parallel to that of the fuel rich core 98. This provides an outer air sheath which is separated from the fuel-rich core 98 by a thin air layer consisting of the tertiary air. As a result, stratification of the air and atomized fuel occurs in the furnace area adjacent the nozzle 55. In this manner, the flame is lengthened by delaying the complete mixing of the air and fuel until the fuel rich core has proceeded down the furnace chamber whereby the flame temperature can be held below about 2500° F so that significant quantities of nitrogen oxides are not formed.

Although the screen 90 and the air spinning vanes 92 are not essential, they are desirable to prevent a backflow of fuel and air around the nozzle 55. Specifically, a small quantity of air from the damper assembly 34 passes through the screen 90 and a second minor portion passes through the tangentially oriented vanes 92 of the air delivery assembly. The air flow through the screen and the vanes 92 prevents the formation of a slight vacuum adjacent the burner nozzle assembly 55 due to air flow around the annular plate 93 and the flow from the nozzle 55. It will be appreciated that the formation of a slight vacuum upstream of the plate 93 would tend to draw fuel and air rearwardly of the nozzle 55. Although the vanes 92 tend to create a vortex action, this portion of the combustion air flow is minor compared with the quantity flowing annularly through the unrestricted annular passage 95, and accordingly, does not significantly affect the formation of the central fuel rich core 98 within the furnace 33. Rather, the slight spiral flow is interposed between the tertiary air flow forming the core stream and the axially flowing sheath air and tends to promote mixing of the sheath air and the core stream at points axially remote from the injection point.

Conventional means may be provided to vary the position of the rotatable damper assembly 34 in response to combustion conditions within the boiler furnace section 33. Such means are well known in the art and do not form a part of the invention, but are mentioned to point out the damper function in general. It will be appreciated that changing of the damper position will not only change the quantity of air flowing through the damper into the furnace, but will also change the pressure head within the plenum chamber and thus indirectly vary the amount of tertiary air flow through duct 86 in an inverse relationship to the quantity of air flowing through the damper assembly 34. Thus, if the damper is rotated to restrict air flow, the plenum chamber pressure head will build and thus increase the tertiary air flow which in turn tends to compress the fuel rich core stream within the furnace and the converse is true when the damper assembly is rotated to permit greater air flow through the apertures 46 and 47.

At points axially close to the nozzle 55, the core stream burns as a fuel rich mixture substantially isolated from the sheath air flowing around it which is necessary for complete combustion of the fuel mixture. As the flow proceeds axially away from the injection point, progressive mixing of the sheath air and core stream takes place along until combustion of the fuel has been substantially completed. The resulting burning is substantially cooler than under conventional practices wherein complete mixing and combustion is not delayed in the manner described. This is due to the removal of some of the heat of combustion prior to complete mixing and combustion and thus prevents the formation of significant levels of nitrogen oxides in the combustion gases by reducing the combustion temperature below the level at which nitrogen oxides form or approximately 2500° F.

While only a single embodiment of the invention has been described, the scope of the invention is not intended to be limited thereby. Accordingly, the scope of the invention is to be taken solely from an interpretation of the claims which follow.

I claim:

1. Apparatus for burning fuel comprising:

means defining a combustion zone having an inlet, nozzle means including fuel discharge means for injecting a fuel into said combustion zone, the movement of fuel into said zone defining a downstream direction, said fuel discharge means including a generally conical outside surface, said fuel discharge means being operative to effect the discharge of said fuel in a generally conical flow pattern which diverges in said downstream direction and away from said nozzle means, said nozzle means also including flame shaping means disposed adjacent said fuel discharge means and including a generally conical outside flame shaping surface diverging in said downstream direction and terminating on its inner end in a central aperture disposed in a surrounding relation to the conical outside surface of said fuel discharge means, said flame shaping means also includes an inner generally conical inside surface disposed adjacent and generally complementary to said conical outside surface of said discharge means, said fuel discharge means being generally hollow and having a plurality of generally radially extending apertures terminating in an outer peripheral surface, conduit means surrounding said fuel discharge means to define a space with said peripheral surface and connected to a source of pressurized air for atomizing fuel exiting said radially extending apertures, and groove means formed in one of said inside and outside adjacent conical surfaces and extending between said space and said central aperture and at an angle relative to the axis of said nozzle means to impart a spinning action to the fuel exiting said central aperture, said flame shaping surface being disposed in closely surrounding relation to said conical flow pattern and extending in the same general direction, the fuel exiting said fuel discharge means moving across said flame shaping surface, said movement tending to cause said fuel to closely follow said flame shaping surface whereby said fuel is shaped into a fuel-rich core stream, pipe means disposed in concentric surrounding relation to said nozzle means for delivering a minor portion of the combustion supporting gas in closely surrounding relation to said core stream to minimize the outward expansion thereof, means defining air passage means disposed about said nozzle means and communicating with the inlet of said combustion zone, and air delivery means connected to said air passage defining means for delivering the major part of the combustion supporting gas through said passage means and into said combustion zone in a surrounding relation to said nozzle means and generally in the downstream direction relative to said combustion zone and inwardly toward said core stream.

2. The apparatus set forth in claim 1 wherein said air delivery means includes flow directing means disposed between said air passage defining means and said nozzle means and cooperating with said inlet for directing said gas inwardly toward said core stream as it passes through said inlet, said nozzle means and said inlet cooperating to redirect said gas in a direction generally parallel to said core stream and in a surrounding relation thereto after passing through said inlet.

3. The apparatus set forth in claim 2 wherein said flow directing means comprises baffle means disposed in an opposed relation to said inlet and having its outer periphery disposed in spaced relation therefrom to define an air flow gap disposed in surrounding relation to said nozzle means.

4. The apparatus set forth in claim 3 wherein the outer periphery of said baffle means is substantially the same size as said inlet.

5. The apparatus set forth in claim 4 wherein said baffle means includes passage means to permit the flow of a minor portion of said gas through said baffle means to prevent the back flow of fuel from said core stream.

6. Apparatus for burning fuel comprising:

means defining a combustion zone having an inlet, nozzle means including fuel discharge means for injecting a fuel into said combustion zone, the movement of fuel into said zone defining a downstream direction, said fuel discharge means being operative to effect the discharge of said fuel in a generally conical flow pattern which diverges in said downstream direction and away from said nozzle, said nozzle means also including flame shaping means disposed adjacent said fuel discharge means and including means defining a flame shaping surface disposed in closely surrounding relation to said conical flow pattern and extending in the same general direction, the fuel exiting said fuel discharge means moving across said flame shaping surface, said movement tending to cause said fuel to closely follow said surface whereby said fuel is shaped into a fuel-rich core stream, means defining air passage means disposed about said nozzle means and communicating with the inlet of said combustion zone, air delivery means connected to said air passage defining means for delivering the major part of the combustion supporting gas through said air passage means and into said combustion zone in a surrounding relation to said nozzle means and generally in the downstream direction relative to said combustion zone and inwardly toward said core stream, said air delivery means includes baffle means disposed between said air passage defining means and said nozzle means and in an opposed relation to said inlet and having its outer periphery disposed in spaced relation therefrom to define an air flow gap disposed in surrounding relation to said nozzle means, the outer periphery of said baffle means being substantially the same size as said inlet, said baffle means cooperating with said inlet for directing said gas inwardly toward said core stream as it passes through said inlet, said nozzle means and said inlet cooperating to redirect said gas in a direction generally parallel to said core stream and in a surrounding relation thereto after passing through said inlet.

7. The apparatus set forth in claim 6 wherein said baffle means includes passage means to permit the flow of a minor portion of said gas through said baffle means to prevent the back flow of fuel from said core stream.

8. Apparatus for burning fuel comprising:

means defining a combustion zone having an inlet, nozzle means for injecting a fuel into said combustion zone, the movement of fuel into said zone defining a downstream direction, said nozzle means including a portion having a generally conical outside surface and being operative to effect the discharge of said fuel in a generally conical flow pattern which diverges in said downstream direction and away from said nozzle means, said nozzle means also including flame shaping means disposed adjacent said nozzle portion and including a generally conical inside surface disposed adjacent the outside surface of said nozzle portion, a central aperture formed in said flame shaping means and surrounding the generally conical outside surface of said nozzle portion, said nozzle portion being generally hollow and having a plurality of generally radially extending apertures terminating in an outer peripheral surface, conduit means surrounding said nozzle portion and connected to a source of pressurized air for atomizing fuel exiting said generally radially extending apertures, groove means formed in one of said inside and outside adjacent conical surfaces and communicating with the space surrounding said generally radially extending apertures, said flame shaping means has a generally frusto-conical outside surface intersecting said inside surface at said aperture, and said central aperture being disposed adjacent the ends of said grooves whereby the fuel passing outwardly of said grooves will pass over said second outside surface, said grooves extending at an angle relative to the axis of said nozzle means to impart a spinning action to the fuel exiting said central aperture, said flame shaping means outside surface being disposed in closely surrounding relation to said conical flow pattern and extending in the same general direction, the fuel exiting said grooves moving across said flame shaping means outside surface, said movement tending to cause said fuel to closely follow said flame shaping means outside surface whereby said fuel is shaped into a fuel-rich core stream, means defining air passage means disposed about said nozzle means and communicating with the inlet of said combustion zone, and air delivery means connected to said air passage defining means for delivering the major part of the combustion supporting gas through said passage means and into said combustion zone in a surrounding relation to said nozzle means and generally in the downstream direction relative to said combustion zone and inwardly toward said core stream.

9. The apparatus set forth in claim 8 and including pipe means disposed in concentric surrounding relation to said nozzle means for delivering a minor portion of the oxygen supporting gas in closely surrounding relation to said atomized fuel to minimize the outward divergencies of said atomized fuel.

10. The apparatus set forth in claim 9 wherein, said nozzle means is disposed adjacent said inlet for directing said air fuel mixture through said inlet and into said combustion zone, said air delivery means including flow directing means disposed between said air passage defining means and said nozzle means and cooperating with said inlet for directing said gas inwardly toward said core stream as it passes through said inlet, said nozzle means and said inlet cooperating to redirect said gas in a direction generally parallel to said core stream and in a surrounding relation thereto after passing through said inlet.

11. The apparatus set forth in claim 10 wherein said flow directing means comprises baffle means disposed in an opposed relation to said inlet and having its outer periphery disposed in spaced relation therefrom to define an air flow gap disposed in surrounding relation to said nozzle means.

12. The apparatus set forth in claim 11 wherein the outer periphery of said baffle means being substantially the same size as said inlet.

13. Apparatus for burning fuel comprising:

first means defining a combustion zone having an inlet, second means disposed adjacent said inlet for injecting a fuel through said inlet and into said combustion zone and for simultaneously injecting with said fuel a first portion of an oxygen containing gas required for stoichiometric combustion to form a fuel-rich core stream in said zone;

third means for introducing into said zone a second portion of the oxygen containing gas required for substantial stoichiometric combustion in a stratified surrounding relation to said core stream so that said gas and core stream remain substantially unmixed over at least a portion of said combustion zone but which mix substantially in a downstream region of said zone, means defining air passage means surrounding said second means and communicating with said inlet, said third means includes air delivery means connected to said air passage defining means for delivering at least a part of said second gas portion for passage into said combustion chamber in a surrounding relation to said second means, said air delivery means including baffle means disposed between said air passage defining means and said second means and cooperating with said inlet for directing said gas inwardly toward said core stream as it passes through said inlet, said second means and said inlet cooperating to redirect said gas in a direction generally parallel to said core stream and in a surrounding relation thereto after passing through said inlet, said baffle means being disposed in an opposed relation to said inlet and having its outer periphery disposed in spaced relation therefrom to define an air flow gap disposed in surrounding relation to said second means, the outer periphery of said baffle means being substantially the same size as said inlet, said baffle means also including passage means to permit the flow of a minor portion of said gas through said baffle means to prevent the back flow of fuel from said core stream, said baffle means having an annular portion surrounding said second means and a plurality of axially extending vanes coupled at one end to the inner periphery of said annular portion and on the side thereof opposite to said inlet, said vanes being oriented to direct said gas in a generally tangential relation to said second means.

14. The apparatus set forth in claim 13 wherein said baffle means includes gas pervious means surrounding said second means and coupled at its outer periphery to the other end of said vanes.

15. Apparatus for burning fuel comprising:

first means defining a combustion zone including an inlet, nozzle means for injecting a fuel into said combustion zone and for simultaneously injecting with said fuel a first portion of an oxygen containing gas required for stoichiometric combustion to form a fuel-rich core stream in said zone, second means for introducing into said zone a second portion of the oxygen containing gas required for substantial stoichiometric combustion in a stratified surrounding relation to said core stream so that said gas and core stream remain substantially unmixed over at least a portion of said combustion zone but which mix substantially in a downstream region of said zone, said nozzle means being disposed adjacent said inlet and having an inner orifice for spirally discharging fuel, said nozzle direction said fuel and oxygen containing gas through said inlet and into said combustion zone, means for defining air passage means surrounding said nozzle means and communicating with said inlet, said second means including air delivery means connected to said air passage defining means for delivering another part of said second gas portion for passage into said combustion chamber in a surrounding relation to said nozzle means, said air delivery means including flow directing means disposed between said air passage defining means and said nozzle means and cooperating with said inlet for directing said gas inwardly toward said core stream as it passes through said inlet, said nozzle means and said inlet cooperating to redirect said gas in a direction generally parallel to said core stream and in a surrounding relation thereto after passing through said inlet, said flow directing means comprising baffle means disposed in an opposed relation to said inlet and having its outer periphery disposed in spaced relation therefrom to define an air flow gap disposed in surrounding relation to said nozzle means, the outer periphery of said baffle means being substantially the same size as said inlet, said baffle means including passage means to permit the flow of a minor portion of said gas through said baffle means to prevent the back flow of fuel from said core stream and having an annular portion surrounding said nozzle means and a plurality of axially extending vanes coupled at one end to the inner periphery of said annular portion and on the side thereof opposite to said inlet, said vanes being oriented to direct said gas in a generally tangential relation to said nozzle means, first pipe means connected to said nozzle means for delivering fuel thereto, second pipe means disposed in concentric surrounding relation to said first pipe means and connected to said nozzle means for delivering said first portion of the oxygen containing gas thereto, third pipe means disposed in concentric surrounding relation to said second pipe means and terminating adjacent said nozzle means for injecting a part of said oxygen containing gas in closely surrounding relation to said fuel-rich core stream.

16. The apparatus set forth in claim 15 wherein said baffle means includes gas pervious means surrounding said second means and coupled at its outer periphery to the other end of said vanes.

17. Apparatus for burning fuel comprising:

first means defining a combustion zone having an inlet, a nozzle disposed adjacent said inlet for injecting a fuel through said inlet and into said combustion zone and for simultaneously injecting with said fuel a first portion of an oxygen containing gas required for stoichiometric combustion to form a fuel-rich core stream in said zone, said nozzle having an inner fuel dispensing orifice, third means for introducing into said zone a second portion of the oxygen containing gas required for substantial stoichiometric combustion in a stratified surrounding relation to said core stream so that said gas and core stream remain substantially unmixed over at least a portion of said combustion zone but which mix substantially in a downstream region of said zone, said third means including first gas delivery means diposed in concentric surrounding relation to said nozzle for injecting a part of said oxygen containing gas in closely surrounding relation to said fuel-rich core stream, said nozzle including a first portion having a generally conical outside surface, a second portion having generally conical inside and outside surfaces and disposed adjacent the outside surface of said first nozzle portion, said surfaces intersecting at said orifice, groove means formed in one of said inside and outside adjacent conical surfaces and extending at an angle relative to the axis of said nozzle to impart a spinning action to the fuel exiting said orifice, said orifice being formed in said second nozzle portion and surrounding the end portion of said first nozzle portion, said aperture being disposed adjacent the ends of said grooves whereby the fuel passing outwardly of said grooves will pass over said second outside surface, said first nozzle portion being generally hollow and has a plurality of radially extending apertures terminating in an outer peripheral surface, conduit means surrounding said first nozzle portion and connected to a source of pressurized air for atomizing fuel exiting said radial apertures, said grooves communicating with the space surrounding said radial apertures, first pipe means connected to said first nozzle portion for delivering fuel thereto, second pipe means connected to said second nozzle portions and disposed in concentric surrounding relation to said first pipe means for delivering a first gas portion thereto, and third pipe means disposed in concentric surrounding relation to said second pipe means and connected at said first gas delivery means, means defining air passage means surrounding said nozzle and communicating with said inlet, said third means including second air delivery means connected to said air passage defining means for delivering another part of said second gas portion for passage into said combustion chamber in a surrounding relation to said nozzle means, said second air delivery means including baffle means disposed between said air passage defining means and said nozzle and cooperating with said inlet for directing said gas inwardly toward said core stream as it passes through said inlet, said nozzle and said inlet cooperating to redirect said gas in a direction generally parallel to said core stream and in a surrounding relation thereto after passing through said inlet, said baffle means having an outer periphery substantially the same size as said inlet and being disposed in an opposed relation to said inlet and having its outer periphery disposed in spaced relation therefrom to define an air flow gap disposed in surrounding relation to said nozzle, said baffle means also having an annular portion surrounding said nozzle and a plurality of axially extending vanes coupled at one end to the inner periphery of said annular portion and on the side thereof opposite to said inlet, said vanes being oriented to direct a minor portion of said gas in a generally tangential relation to said nozzle.

18. The apparatus set forth in claim 17 wherein said baffle means includes gas pervious means surrounding said second means and coupled at its outer periphery to the other end of said vanes.

19. Apparatus for burning fuel comprising:

means defining a combustion zone having an inlet, nozzle means for injecting fuel into said combustion zone, the direction of fuel from said nozzle into said zone defining a downstream direction, said nozzle means including first means for receiving fuel to be burned, second means disposed radially outwardly of said first means and defining an atomizing space, and third means for delivering pressurized combustion supporting gas to said atomizing space, a first plurality of passage means formed in said nozzle means and extending between said first means and said atomizing space for delivering fuel outwardly from said first means for being atomized by the combustion supporting gas delivered by said third means, said nozzle means having an outer concave flame shaping surface formed thereon and defined by spaced apart inner and outer peripheral margins, said surface diverging outwardly from said inner to said outer peripheral margins and in the downstream direction, a second plurality of passage means formed in said nozzle means and extending from said atomizing space, and terminating adjacent the inner peripheral margin of said flame shaping surface, said second plurality of passages being arranged to whirl and direct said atomized fuel along said flame shaping surface in directions parallel with and closely adjacent said flame shaping surface whereby the atomized fuel exiting said second plurality of passages moves outwardly along said flame shaping surface and in closely spaced relation thereto whereby said fuel is shaped into a fuel rich core stream.

20. The apparatus set forth in claim 19 and including fourth means disposed in closely surrounding relation to said nozzle means and defining an air passage communicating with the inlet of said combustion zone, and air delivery means connected to said fourth means for delivering a minor portion of combustion supporting gas into said air passage and into said combustion zone in surrounding relation to said nozzle means and generally in the downstream direction relative to said combustion zone, said fourth means including means for directing said gas inwardly toward said core stream to minimize the outward divergence thereof.

21. The apparatus set forth in claim 19 wherein said first means has a generally conical outside surface, the inner periphery of said flame shaping surface comprising a central aperture diposed in surrounding relation to the conical outside surface of said first means.

22. The apparatus set forth in claim 21 wherein said flame shaping surface is formed on a flame shaping member which also includes an inner generally conical surface disposed in engagement with and complementary to said conical outside surface of the first means, said second plurality of passage means comprising groove means formed in one of said inner and outside adjacent conical surfaces and extending at an angle relative to the axis of said nozzle to impart a spinning action to the fuel exiting said aperture.

23. The apparatus set forth in claim 22 wherein said first means is generally hollow and has an outer peripheral surface, said first plurality of passages extending generally radially and terminating in said peripheral surface, said second means comprising conduit means surrounding said first means to define said space with said peripheral surface, said groove means communicating with the space surrounding said passages.

24. The apparatus set forth in claim 23 and including pipe means disposed in concentric surrounding relation to said conduit means for delivering a minor portion of the combustion supporting gas in closely surrounding relation to said core stream to minimize the outward expansion thereof.

25. The apparatus set forth in claim 24 and including air passage defining means surrounding said pipe means and flow directing means disposed between said air passage defining means and said nozzle means and cooperating with said inlet for directing said gas inwardly toward said core stream as it passes through said inlet, said nozzle means and said inlet cooperating to redirect said gas in a direction generally parallel to said core stream and in a surrounding relation thereto after passing through said inlet.

26. The apparatus set forth in claim 25 wherein said flow directing means comprises baffle means disposed in an opposed relation to said inlet and having its outer periphery disposed in spaced relation therefrom to define an air flow gap disposed in surrounding relation to said nozzle means.

27. The apparatus set forth in claim 26 wherein the outer periphery of said baffle means is substantially the same as said inlet.

28. Apparatus for burning fuel comprising:

means defining a combustion zone having an inlet, nozzle means including fuel discharge means for injecting a fuel into said combustion zone, the movement of fuel into said zone defining a downstream direction, said fuel discharge means including a generally conical outside surface and a fuel receiving space, means for delivering combustion supporting gas to said fuel receiving space, said nozzle means also including flame shaping means disposed adjacent said fuel discharge means and including a generally frusto-conical, concave, outside flame shaping surface diverging outwardly in said downstream direction and terminating on its inner end in a central aperture disposed in a surrounding relation to the conical outside surface of said fuel discharge means and at its outer end in a peripheral margin, said flame shaping means also including generally conical inside surface disposed adjacent and generally complementary to said conical outside surface of said fuel discharge means, a plurality of passages formed in one of said inside and outside conical surfaces and extending between said fuel receiving space and the center aperture of said flame shaping surface, said second plurality of passages being arranged in a generally conical array and oriented inwardly in the direction of said inside and outside surfaces and extending from said receiving space to said central aperture to direct said atomized fuel in a generally conical array and closely spaced relative to and in general parallelism with said flame shaping surface whereby the fuel exiting said second plurality of passages moves outwardly along said flame shaping surface whereby said fuel is shaped into a fuel rich core stream.

29. The apparatus set forth in claim 28 and including air delivery means disposed in surrounding relation to said nozzle means and defining an air passage communicating with the inlet of said combustion zone for delivering combustion supporting gas into said combustion zone in surrounding relation to said nozzle means and generally in the downstream direction relative to said combustion zone, said air delivery means including means for directing said gas inwardly toward said core stream to minimize the outward divergence thereof.

* * * * *

UNITED STATES PATENT OFFICE

CERTIFICATE OF CORRECTION

Patent No. 3,963,182 Dated June 15, 1976

Inventor(s) Roy M. Rulseh

It is certified that error appears in the above-identified patent and that said Letters Patent are hereby corrected as shown below:

Claim 15, Column 10, Line 60, cancel "direction" and substitute --directing-- .

Signed and Sealed this

Ninth Day of November 1976

[SEAL]

*Attest:*

RUTH C. MASON
*Attesting Officer*

C. MARSHALL DANN
*Commissioner of Patents and Trademarks*